US005769215A

United States Patent [19]

Kim

[11] Patent Number: 5,769,215

[45] Date of Patent: Jun. 23, 1998

[54] TWO-COMPONENT PACKAGE

[75] Inventor: Hyeong Sook (Morin) Kim, Kowloon, Hong Kong

[73] Assignee: Georg Wiegner, Kowloon, Hong Kong

[21] Appl. No.: 785,024

[22] Filed: Jan. 16, 1997

Related U.S. Application Data

[63] Continuation-in-part of Ser. No. 408,598, Mar. 22, 1995, Pat. No. 5,685,422.

[30] Foreign Application Priority Data

Mar. 22, 1994 [DE] Germany ..... 44 09 696.8

[51] Int. Cl.[6] ..... B65D 25/08

[52] U.S. Cl. ..... 206/222

[58] Field of Search ..... 206/222, 221, 206/219, 568

[56] References Cited

U.S. PATENT DOCUMENTS

| | | | |
|---|---|---|---|
| 3,220,588 | 11/1965 | Lipari | 206/222 |
| 3,344,914 | 10/1967 | Bloom et al. | 206/222 |
| 3,347,410 | 10/1967 | Schwartzman | 206/222 X |
| 3,537,605 | 11/1970 | Solowey | 206/222 |
| 3,548,562 | 12/1970 | Schwartzman | 206/222 X |
| 3,802,604 | 4/1974 | Morane et al. | 206/222 X |
| 4,067,440 | 1/1978 | Lataix | 206/222 |
| 4,103,772 | 8/1978 | Wiegner | 206/222 |
| 4,174,035 | 11/1979 | Wiegner | 206/222 |
| 4,247,001 | 1/1981 | Wiegner | 206/222 |
| 4,465,183 | 8/1984 | Saito et al. | 206/222 |
| 4,682,689 | 7/1987 | Pereira et al. | 206/222 |
| 5,170,888 | 12/1992 | Gonclaves | 206/222 |
| 5,409,141 | 4/1995 | Kikuchi et al. | 206/221 X |
| 5,685,422 | 11/1997 | Kim | 206/222 |

FOREIGN PATENT DOCUMENTS

| | | |
|---|---|---|
| 0101594 | 8/1983 | European Pat. Off. . |
| 0538891 | 4/1993 | European Pat. Off. . |
| 26 22 364 | 12/1976 | Germany . |
| 3230357 | 2/1984 | Germany . |

*Primary Examiner*—Bryon P. Gehman
*Attorney, Agent, or Firm*—Steven F. Caserza; Flehr Hohbach Test Albritton & Herbert

[57] ABSTRACT

Container for storing two different substances, having a first compartment containing a liquid, a second compartment containing another liquid, a separating body which separates the two compartments, and a puncturing device comprising a tool which breaks the separating body when required and can be moved by hand by means of at least one transmitting part which transmits compression forces, such that the transmitting part is designed as a puncturing device comprising a press member having a press shank which is lengthened upon appliance of a lateral squeezing force onto the side walls of the compartment containing the puncturing device.

10 Claims, 2 Drawing Sheets

TWO-COMPONENT PACKAGE

RELATED APPLICATIONS

This is a continuation-in-part of U.S. patent application Ser. No. 08/408,598, filed Mar. 22, 1995, now U.S. Pat. No. 5,685,422.

BACKGROUND OF THE INVENTION

The invention relates to a container for storing two different substances, having a first compartment containing a liquid, a second compartment containing another liquid, a separating body which separates the two compartments, and a tool which breaks the separating body when required and which can be moved by hand by means of at least one transmitting part which transmits compression forces.

DESCRIPTION OF THE PRIOR ART

Containers for storing two different substances are known from U.S. Pat. Nos. 4,103,772 and 4,247,001. Such containers, also called two-component packages, are always used whenever two components are required for application which have to be brought into contact with each other prior to use but, once mixed, lose their effectiveness very quickly. This is the case, for example, with cosmetic preparations, such as hair coloring agents.

A dual container is known from U.S. Pat. No. 4,103,772, which has a main container 2 and an additional container 3, the two flanges of the containers being welded together when the containers have been filled. In this case, the additional container has a deformable top part 5 onto which cutting tools 6 are molded, the elastically deformable top part 5 being arranged in a sealed manner on the terminating skin 10 which can be pushed through.

A two-component package is likewise known from U.S. Pat. No. 4,247,001. This two-component package has a separating film which can be broken by a sharp-edged punching tool when required. In this case, the punching tool lies in one of the containers. The punching tool has resilient elements 16 which center it in the container and guarantee a minimum distance from the separating film when the container has not been deformed. According to the US Patent, the container which receives the punching tool has a region 15 which is shaped in the manner of a concertina and serves to allow the container to be squeezed together in its longitudinal extent when required In this case, the bottom of the container holding the punching tool presses the punching tool against the separating film, as a result of which the latter is broken.

The disadvantages of the prior art structures are, on the one hand, the complicated connection technique, in which the two containers forming the two-component package are welded together, high temperatures thermally transforming the material of the flanges, as a result of which leakiness often occurs, and, on the other hand, a great force required to be applied by the user in order to break the separating film in the container. It is particularly disadvantageous in this case that, in the two prior art solutions, a compression force constantly has to be exerted on the bottom of the container in the direction of the separating film in order to break the separating film.

It is furthermore disadvantageous that the two containers forming the two-component package are welded together. This prevents the containers later being taken apart without breaking them. Reuse of the parts of the two-component package is thus no longer possible. This does not comply with the current requirements for recovery of raw materials.

SUMMARY OF THE INVENTION

The object of the invention is therefore to develop a container for storing two different substances, in which container small compression forces are sufficient in order to break the separating body which separates the two substances. Additionally, the container is to be designed in such a way that as many of its parts as possible can be reused and a high functional reliability is achieved with a compact and simple construction.

According to the invention this object is achieved in that a puncturing device comprises a press member having a press shank which is lengthened upon appliance of a lateral squeezing force onto the side walls of the compartment containing the puncturing device.

By pressing the container in laterally, the press shank is subjected to pressure by the inside side wall of the container, as a result of which the puncturing device is moved in the direction of the separating body.

It is particularly advantageous for the press shank to be supported by an inside wall of a bottom face of the container. It is thus possible to detach the tool from the container without breaking it and to reuse it. An appropriate connection also facilitates the assembly of the dual container.

Advantageously, the press shank is formed by an annular shank having spaced apart arched side walls being flexible to increase the length of the annular shank by laterally squeezing the side walls together in forming a squeezed press shank having an elongated flattened annular shape.

In a further advantageous design, the annular shank has a shape memory.

The separating body which frangibly seals off the one compartment is advantageously a film, in particular an aluminum foil, which is bonded in a sealing manner or inductively welded to the body forming the compartment. As a result, at least one of the bodies is sufficiently sealed off.

The two vessels forming the two compartments are advantageously held together in a sealing manner by means of at least one clip, the clip having claws, snap-in or clamping connections, such that the clip, when it has been pressed onto the flanges of the vessels, is captively connected thereto. Advantageously, the clip is pressed onto or welded or bonded around the flanges of the vessels. In this case the clip is advantageously made of metal, plastic or aluminum.

The clip can also be replaced by a knurled ring. This results n the two vessels being sealed together particularly well.

In order to achieve an even better sealing-together of the two vessels, a sealing part, in particular a sealing ring, can be placed between the two flanges of the vessels and the separating body. In this case, the sealing ring is clamped by the clip or the knurled ring between the flanges of the vessels and thus seals off the openings of the vessels sufficiently.

The bottom of the vessel which receives the tool is advantageously fitted with an intended creasing point or an intended creasing groove, such that the bottom can preferably crease inwards in the axial direction when the side walls of the vessel are squeezed together transversely to the direction of movement of the tool. Owing to the provision of an intended creasing point, the compression force to be applied to deform the container is likewise further reduced. The force to be raised can be reduced considerably by the use of an easily deformable plastic.

An exemplary embodiment of the invention is illustrated in the drawing and explained in greater detail below.

DETAILED DESCRIPTION

Figure 1:
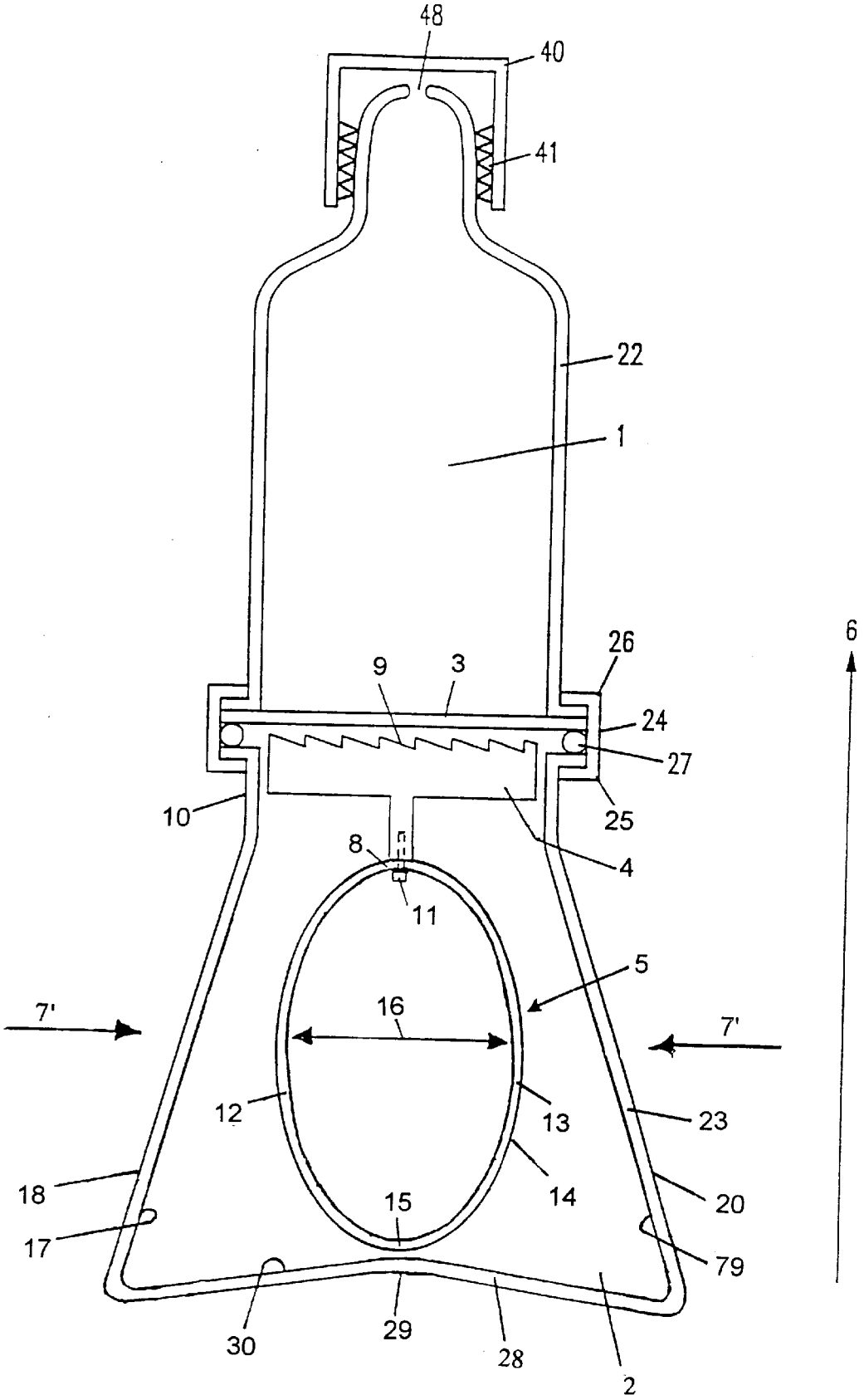
FIG. 1 shows a container for storing two different substances according to the invention.
Figure 2:
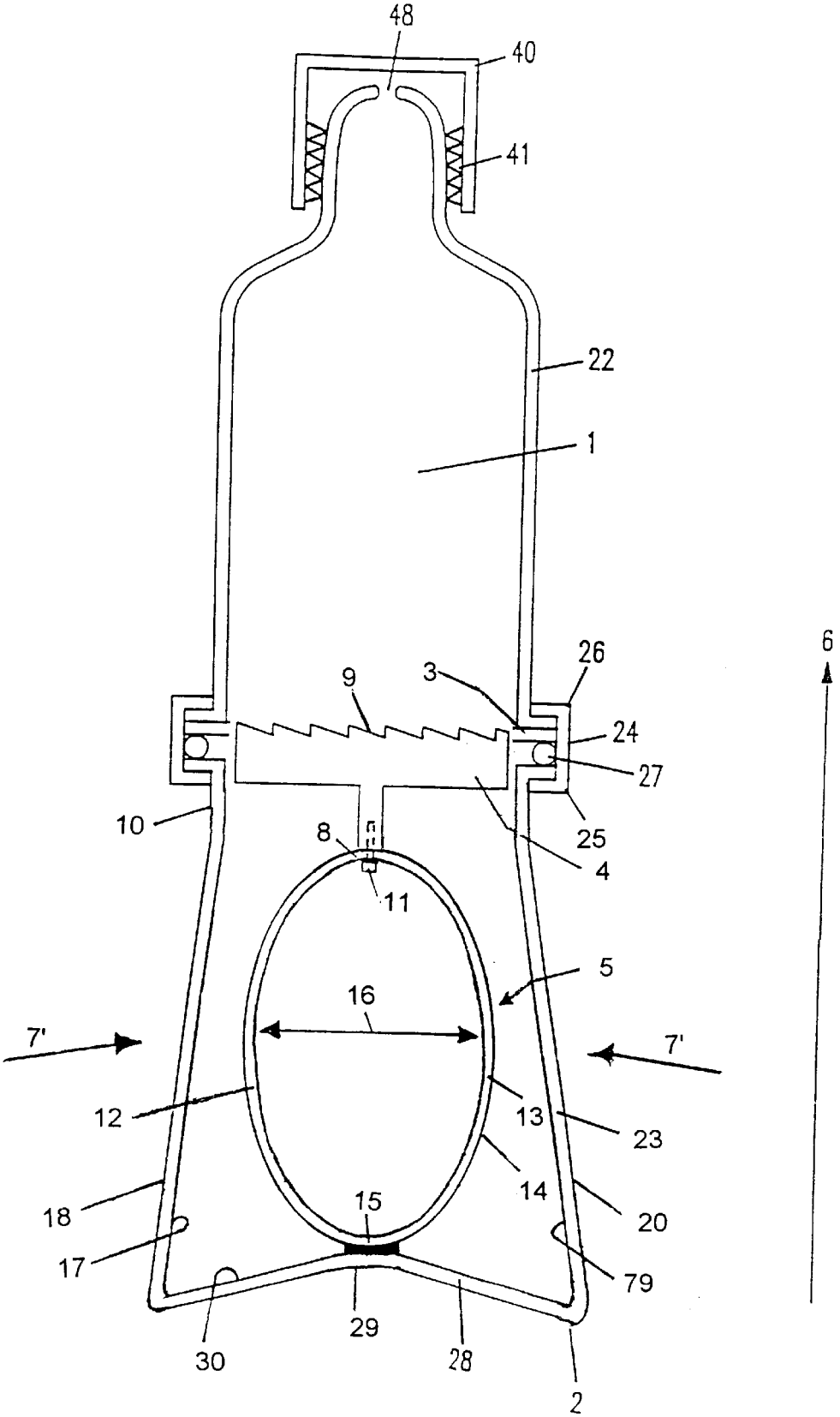
FIG. 2 shows the container with the puncturing device puncturing the frangible seal.

FIG. 1 shows a container for storing two different substances, having a first compartment 1 containing a first liquid, powder or the like, and a second compartment 2 for receiving a second liquid, powder or the like. Lying within the vessel 2 is a puncturing device 5 which comprises a press shank 14 and a tool 4. The first and second compartments 1 and 2 are separated by a separating body 3 which seals off at least one compartment 1 or 2 and can be broken by the puncturing device 5, in particular by the tool 4, when the compartment 2 is laterally squeezed causing the puncturing device 5 to move against the separating body 3 in the direction, indicated by the arrow 6, to break the seal and to enable mixing of the substances contained in the compartments 1 and 2 prior to a dispensing thereof from the container. FIG. 2 shows the container with the puncturing device puncturing the frangible seal.

The puncturing device 5 is a transmitting part to transmit a lateral squeezing force applied to deform the compartment 2, as indicated by the arrows 7, 7', to the separating body 3 for breaking the separating body 3. The puncturing device 5 comprises the press shank 14 which is lengthened upon appliance of the lateral squeezing force indicated by the arrows 7, 7'. While being extended the press shank 14 is supported by the inside 30 of the bottom wall 28 of the compartment 2, so that the press shank 14 can extend towards the separating body 3. At a top end 8 of the press shank 14 is mounted the tool 4 being designed as a die with a sharp knife edge 9. Using fixing means 11 the tool 4 is detachably fixed onto the press shank 14. The puncturing device 5 is arranged in the compartment 2 in such a way that it is guided within the compartment 2 to guarantee that an increased length of the press shank 14 pushes the tool 4 against the separating body 3. Preferably, the tool 4 is guided within a top end 10 of the compartment 2.

The press shank 14 is length-extendable in direction 6 in response to a squeezing force as indicated by arrows 7, 7'. To allow such a length increase, the press shank 14 comprises an annular shank having spaced apart arched side walls 12 and 13 being joint at the top end 8 and a bottom end 15. The side walls 12 and 13 are flexible to allow a deforming of the annular shank 14 into a shank having a flattened annular shape of greater length due to a smaller width 16. It is, thus, guaranteed that, when the container, in particular compartment 2, is squeezed together laterally, the inside walls 17, 19 of side walls 18, 20 of the compartment 2 squeeze together the side walls 12, 13 of the press shank 14 by acting against them, causing the side walls 12, 13 to approach each other, decreasing the width 16 in between and increasing the length of the press shank 14 in direction 6 while being supported with its bottom end 15 by the bottom wall 28 of the compartment 2.

The increasing of the length of the press shank 14 is chosen such that the tool 4 is sufficiently moved towards the separating body 3 as a result of which the separating body 3 is broken.

Preferably, the material and the shape of the annular press shank 14 is chosen such that the press shank 14 has a shape memory. For example, the annular press shank 14 is made from a band material, in particular plastic material.

The bottom 28 of the compartment 2 is preferably shaped inwards and has an intended creasing point 29 which guarantees that the bottom 28 can easily be pivoted inward when the container is squeezed together.

The vessels 22 and 23 forming the compartments 1 and 2 have flanges 25, 26. In this case, the one vessel is welded or bonded to the one flange of a vessel by means of a separating body 3, in particular a separating foil made of aluminum. Placed between the separating foil and the flange of the other vessel is a sealing part, in particular a sealing ring. The two flanges of the vessels 22 and 23 are pressed against each other by means of a clip. For this purpose, the clip is pressed on, beaded or bonded around the flanges 25 and 26. By means of this design, the vessel connection is sufficiently sealed off.

While the diameter of the vessel 23 tapers here, in a design which is not illustrated, the vessel 23 may by a cylindrical body.

The container of this invention also includes, if desired, a cover or cap 40, together with threads 41 for securing cap 40 to vessel 22, covering opening 48.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

I claim:

1. A container for separately packaging two different substances and for enabling mixing of said substances prior to dispensing thereof from said container, comprising:

a first compartment containing a first substance and a second compartment containing a second substance;

a frangible seal separating said first and second compartments;

a discharge port for enabling discharge from at least one of said compartments of a mixture of said substances; and a puncturing device for breaking said frangible seal to establish a communication between said compartments; and said puncturing device comprising a length extendable press shank and at a top end thereof a die with a sharp knife edge adjacent said frangible seal, said device being contained within one of said compartments in a guided manner to break said frangible seal upon application of a force against said press shank by laterally squeezing said compartment containing said puncturing device to extend the length of said press shank in the direction of said frangible seal, while said press shank is being supported by an inside wall of said compartment containing said functioning device, allowing said sharp knife edge to break said frangible seal.

2. The container according to claim 1, wherein said extendable press shank comprises an annular shank having spaced apart arched side walls being flexible to increase the length of said annular shank by laterally squeezing said side walls of said press shank together in forming a squeezed press shank having an elongated flattened annular shape.

3. The container according to claim 2, wherein said flexible design provides said annular shank with a shape memory.

4. The container according to claim 2, wherein a lower end of said annular shank in said elongated flattened annular shape is supported by an inside wall of a bottom face of said compartment containing said puncturing device.

5. The container according to claim 1, wherein said frangible seal comprises a film which is bonded in a sealing manner to the body forming said compartment containing said puncturing device.

6. The container according to claim 1, wherein said film comprises an aluminum foil.

7. The container according to claim 1, wherein said film is bonded in said sealing manner by inductive welding.

8. The container according to claim 1, wherein said two compartments have flanges to hold them together by at least one clip, each said at least one clip having an attachment selected from claws, snap-in and clamping connections, such that the at least one clip, when it has been pressed onto the flanges, is captively connected thereto.

9. The container according to claim 8, wherein said frangible seal lies between said flanges.

10. The container according to claim 1, wherein a bottom of said compartment containing said puncturing device includes a creasing line in order to yield when lateral walls of said compartment are squeezed together.

* * * * *